United States Patent [19]

Wharton, Jr.

[11] 4,331,287

[45] May 25, 1982

[54] CARTON

[75] Inventor: Paul B. Wharton, Jr., Deerfield, Ill.

[73] Assignee: Kinetics Container Corporation, Des Plaines, Ill.

[21] Appl. No.: 115,091

[22] Filed: Jan. 18, 1980

Related U.S. Application Data

[62] Division of Ser. No. 938,634, Aug. 31, 1978, Pat. No. 4,197,788.

[51] Int. Cl.[3] ..... B65D 5/00

[52] U.S. Cl. ..... 229/16 D; 229/30; 229/31 FS; 229/34 R; 206/45.14; 206/443; 206/486

[58] Field of Search ..... 229/31 FS, 30, 37 R, 229/34 R, 16 D; 206/45.14, 486, 443

[56] References Cited

U.S. PATENT DOCUMENTS

| | | | |
|---|---|---|---|
| 1,897,672 | 2/1933 | Neumann . | |
| 1,974,674 | 9/1934 | Halladay . | |
| 2,217,503 | 10/1940 | Bergstein | 229/31 FS |
| 2,710,094 | 6/1955 | Rau | 229/31 FS |
| 2,742,221 | 4/1956 | Hickin | 229/31 FS |
| 3,360,118 | 12/1967 | Hanson et al. . | |
| 3,388,787 | 6/1968 | Growney . | |
| 3,401,865 | 9/1968 | Holstrom | 206/45.14 |
| 3,784,083 | 1/1974 | Pfaffendorf et al. | 229/31 FS |
| 4,032,006 | 6/1977 | Cantarella et al. . | |
| 4,106,615 | 8/1978 | Hiroshi . | |

FOREIGN PATENT DOCUMENTS 530769 12/1940 United Kingdom .

*Primary Examiner*—Joseph Man-Fu Moy

*Attorney, Agent, or Firm*—Wegner, McCord, Wood & Dalton

[57] ABSTRACT

A carton is provided which has a relatively long depth, a relatively short length and a medium width. The carton includes a back panel having a fastening tab connected on one edge and one side panel connected on the other edge. At least two slots are formed in the back panel with one edge of the slots aligning with the edges of the back panel. A top panel is connected at one edge to the one side panel and is connected at its other edge to a second side panel with the fastening tab fastened to the second side panel. With the four panels assembled as a tube, the top panel has end portions spaced from said back panel and has an opening into the carton between said end portions. Parts of said top panel between said end portions are depressed into said opening to reinforce the sides and the back panel. Tabs are provided on the depressed part of the top panel engaging in the at least two slots in the back panel. An insert is threaded into said opening with the ends of the insert nesting below said end portions of the top panel. The insert has an article support member extending across the length of said carton so that elongate articles can be supported in the carton for display through said opening.

5 Claims, 10 Drawing Figures

CARTON

CROSS-REFERENCE TO RELATED APPLICATIONS

This application is a division of application Ser. No. 938,634, filed Aug. 31, 1978 now U.S. Pat. No. 4,197,788.

BACKGROUND OF THE INVENTION

1. Field of the Invention

This invention relates to a carton and to a more particularly, to an improved set up arrangement and display carton.

2. Description of the Prior Art

Heretofore, cartons were scored and cut in such a way that when shipped to the customer, they were in a flat sheet condition. For set up and assembly, it is necessary to make multiple folds on score lines on all four margins of the edge panels and to interfit tabs and panels on all four sides of the resulting open topped box. The box bottom section results in a panel with four upstanding walls about the periphery of the panel with at least two, and possibly all four, walls being of folded double thickness of corrugated material. There is no connection of opposite side walls at their otherwise free upper edges and thus there is no restraint against outward bowing of such walls away from each other particularly in deep boxes. The bowing of side walls or panels is a common undesirable result. Display pillows or blocks are tabbed into the ends of the carton or an insert is placed into the carton opening which generally has to be attached as by tabs or the like to the sides or bottom of the opening. The inserts sometimes have pockets on the ends thereof to form recesses for receiving the ends of goods to be displayed.

It is extremely time consuming for the set-up person to first fold the sheet, fold the ends, fold the top down into the cavity, and set up and secure the insert therein. The setup is an expensive labor-consuming operation.

SUMMARY OF THE INVENTION

There is provided herein an improved carton that has self-contained pockets at the opposite ends of the display opening thereof and is made in such a way that the sides are reinforced against outward bowing or bulging.

There is also disclosed an improved method of cutting and assembling the carton wherein after cutting and scoring the blank, it is partially preassembled at the cutting factory by folding the back behind the front and gluing the side tab along the one side wall of the ultimate carton. The partially preassembled carton is flattened and shipped to the customer. The customer only has to press the outer edges of the flattened blank toward each other to separate the front and back panels. The ends are then assembled in the usual fashion and with a single blow administered along a partial cut at the center of the front of the carton, the center panel of the top is split into two portions which are then pushed down and in into the corners in the cavity or opening of the carton with tabs on the two portions engaging in slots along the edges of the back. An insert sheet is then assembled in the opening in the carton by threading the ends thereof below overhanging portions of the carton, which insert assists in holding the turned down portions of the top of the carton assembled with the side walls of the carton so as to provide inward and outward support against bowing of the side walls of the carton.

A seventy-five percent saving in set-up time is accomplished using the improved method of assembling a carton which reduces the cost of the finished carton tremendously.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is a schematic view of a carton already set up and ready to receive elongate articles, such as golf clubs, or the like;

DESCRIPTION OF THE PREFERRED EMBODIMENT

Figure 1:
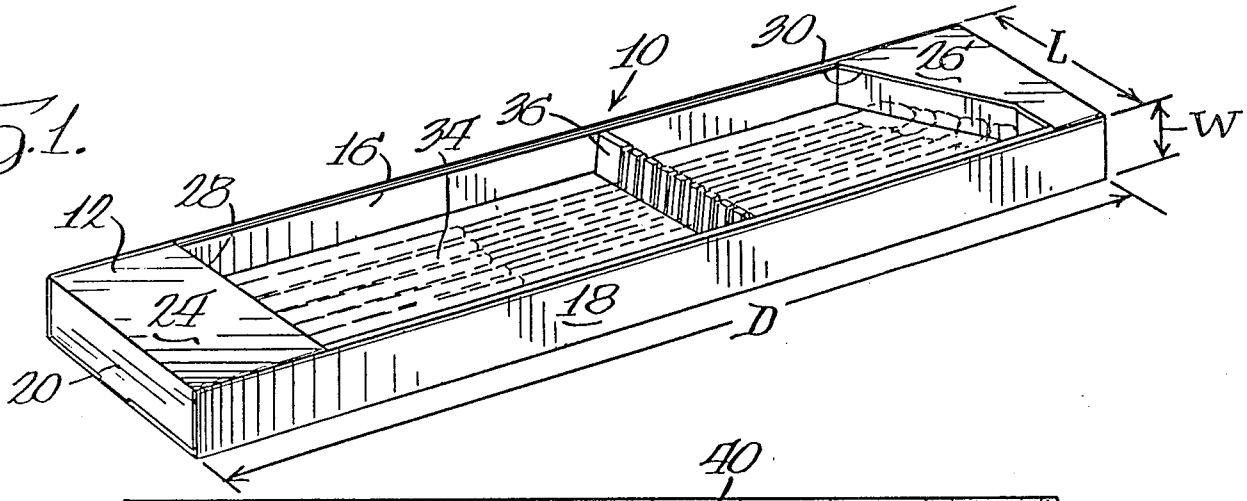

Referring, in particular, to FIG. 1, a carton 10 is illustrated and has an elongate depth D which, in the illustrated form, is approximately forty-five inches, a length L which, as illustrated, is approximately ten inches, and a width W which, as illustrated, is approximately two and one-half inches. The dimensions listed are by way of example and are not intended to be limitations. The carton 10 has a top panel 12, a back panel 14, sides 16 and 18, and ends 20 and 22. The top panel 12 is comprised of overhanging portions 24 and 26 at each end thereof. As illustrated, the overhanging portion 24 is defined by an edge 28 which extends substantially perpendicular to the side walls 16 and 18. The overhanging portion 26 has an edge 30 that forms an angle with the side wall 16, has a knee and has a portion substantially perpendicular to the side wall 18. Nested down inside the cavity of the carton 10 is an insert 34 which has its ends nested beneath the overhangs 24 and 26 and has an upwardly folded article-supporting midportion 36 extending between the side walls 16 and 18. The carton illustrated in FIG. 1 is for displaying, packaging and selling a set of golf clubs wherein the shafts of the clubs will be gripped by slots 38 in the midportion 36 with the handles of the clubs nesting under the overhang 24 and with the head of the clubs nesting against or beneath the overhang 26. It is to be understood that the carton can be used to package many different types of equipment, such as archery equipment, badminton equipment, croquet mallets, and the like.

Figure 2:
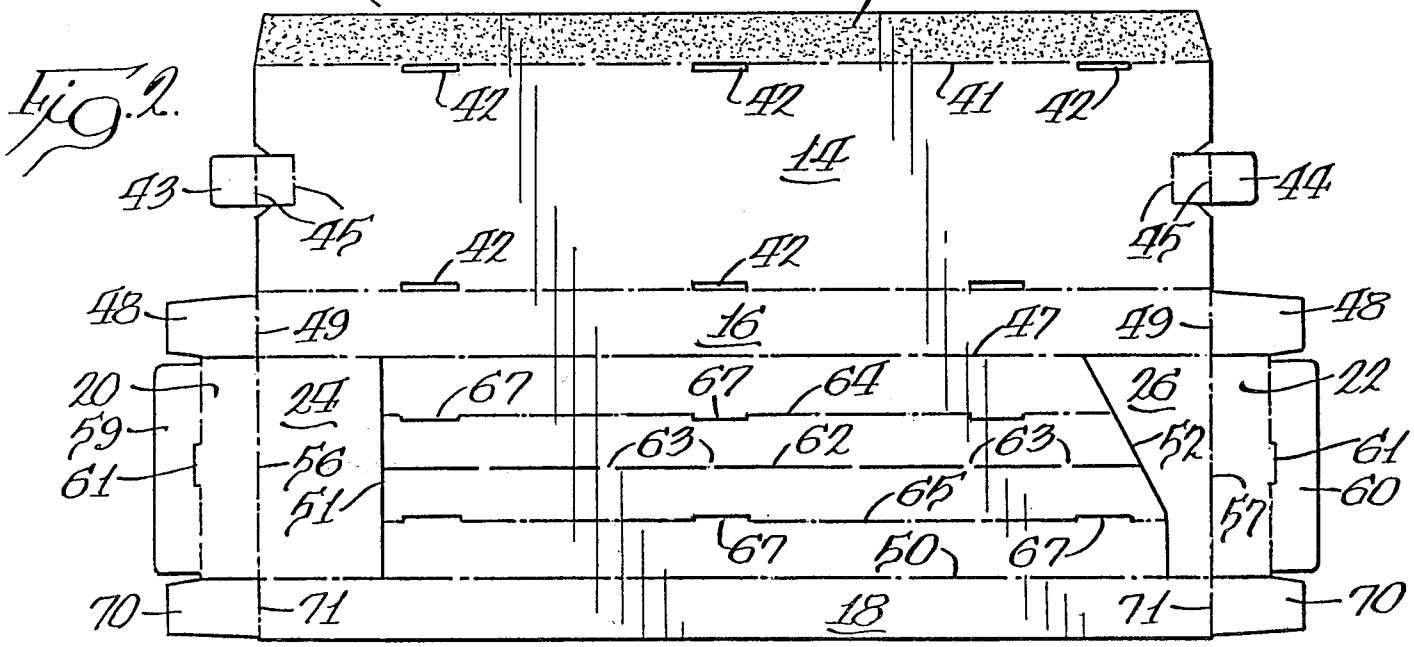
FIG. 2 is a plan view of a scored, cut and slotted corrugated sheet formed into a carton blank.

FIG. 2 illustrates a sheet of corrugated material, such as cardboard, that has been cut into a generally rectangular shape and has all of the various elements of the carton of FIG. 1 laid out therein. Some of the elements of FIG. 2 are not clearly illustrated in FIG. 1 since in the assembled form of FIG. 1, they would not be visible. The blank or sheet of FIG. 2 has a gluing tab 40 along one edge thereof, which tab 40 has a width substantially equal to the width of the carton. The tab 40 is defined by scoring the blank or sheet throughout the depth along a score line 41 which separates the tab 40 from the back panel 14. Three slots 42 are cut through the back panel 14 with one edge of each slot 42 aligning with the score line 41. The material of the slots 42 is completely removed in the cutting operation. The back panel 14 has outwardly extending tabs 43,44 extending from the midportions of the ends thereof and are cut into the back panel 14 a short distance and are scored at 45 across the length thereof along a terminal end of the tab and along a line aligned with the end edge of the back panel. The back panel 14 is likewise scored at line 46 along its other edge opposite the gluing tab 40. Three additional slots 42 are cut through the back panel 14 with one edge of the slots aligning with the score line 46.

Side 16 is defined by said score line 46 and by a parallel score line 47 extending throughout the depth of the blank. Outwardly extending tabs 48 are provided on each end of the side 16, which tabs 48 are scored along the lines 49 where they join the side 16. The top panel 12 is defined on one edge by said score line 47 and is defined on the opposite edge by a score line 50. Two cuts 51 and 52 are made completely through the top panel 12 with cut 51 extending from score line 47 to score line 50 substantially along a line perpendicular to the score lines 47 and 50 to form the edge 28 for the overhang 24. The cut 52 is made between score lines 47 and 50 with part of the cut 52 being at an angle to the score line 47 and the other part of the cut 52 being transverse or perpendicular to the score line 50 to form the edge 30 for the overhang 26. The cut 51 provides a somewhat rectangular panel that becomes overhang 24 at one end of the top and provides a somewhat odd-shaped panel that becomes overhang 26 at the other end portion of said top. Ends 20 and 22 are connected to top panel 12 with score lines 56 and 57 at each end of said top panel 12 to define said ends 20 and 22. Tabs 59 and 60 are provided on the outer edges of ends 20 and 22 spaced from the top panel. The tabs 59 and 60 and ends 20 and 22 have score lines therebetween to define one from the other. Ends 20 and 22 have guide tongues 61 formed along the score line common with the tabs 59 and 60, which tongues 61 extend into the material of the tabs 59,60.

A partial cut or slit 62 is formed midway between the side edges of the top panel 12, which partial cut 62 extends from the cut 51 to the cut 52. The partial cut or slit 62 is formed by cutting all the way through the material with the exception of several spaced short stretches 63. The short stretches 63 are formed by scoring from the inside of the top through the inside sheet and through the center corrugation of the corrugated material, but not through the outside sheet of the corrugated material. A pair of score lines 64 and 65 extend from the cuts or slits 51 and 52 along lines parallel to the partial cut or slit 62 with the score lines 64 and 65 being spaced from the edge score lines 47 and 50 by an amount substantially equal to the width W of the sides 16 and 18. Score lines 64 and 65 have tabs 67 projecting toward the partial cut or slit 62 so that the base of the tabs 67 align with the score lines 64 and 65. As illustrated, the tabs 67 substantially line up with the slots 42 cut in the back panel 14. It should be noticed that on the right-hand portion of FIG. 2, the tabs 67 and slots 42 do not all align with each other along a vertical line. However, one of said right-hand tabs 67 do align with one of said slots 42 and the other right-hand tab 67 aligns with the other right-hand slot 42 for a purpose that will be clear hereinafter. The score line 50 along the one edge of the top panel 12 defines the side 18. Side 18 has end tabs 70 which are separated from the side 18 by score lines 71.

Figures 3, 4, 5, 6, 7:
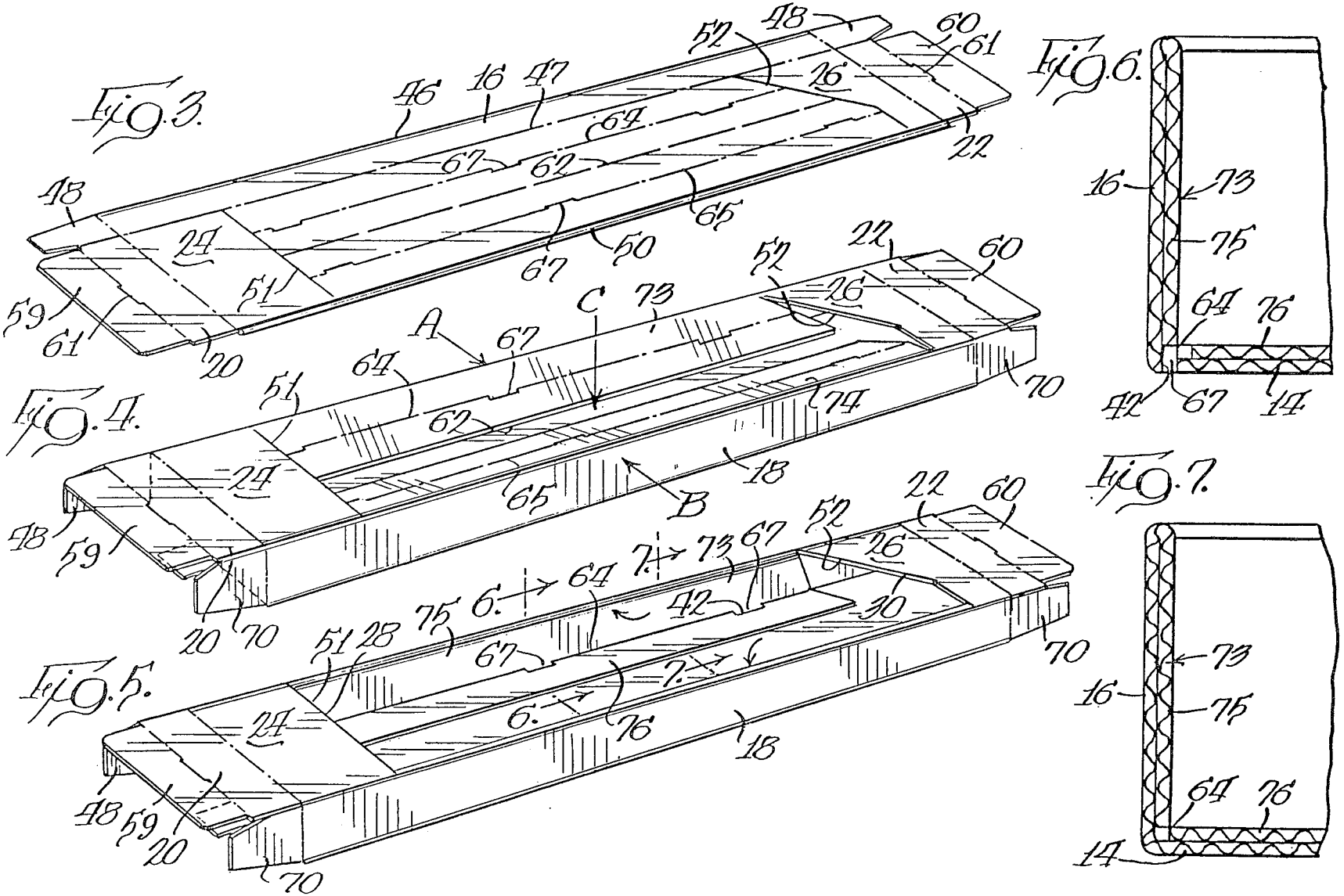
FIG. 3 is a perspective view of the blank of FIG. 2 with one side glued to the tab throughout the depth thereof.
FIG. 4 is the carton of FIG. 3 formed into a tube and illustrates the beginning of the step to sever the top into a display opening.
FIG. 5 shows the severed top being pressed and folded into the corners in the cavity of the carton.
FIG. 6 is a partial broken away, cross-sectional view taken along the line 6—6 of FIG. 5.
FIG. 7 is a partial broken away, cross-sectional view taken along the line 7—7 of FIG. 5.

The blank or sheet of FIG. 2 is folded along the score line 46 and along the score line 50 with the side 18 doubled back upon the back of the top panel 12 and the back panel 14 folded around behind the top panel 12 so that the gluing tab 40 overlaps with the side 18. At this point, the glue on tab 40 is activated and the tab 40 is secured to the inside of side 18 so that a flat two thickness blank, such as shown in FIG. 3, is provided. The form of the blank of FIG. 3 is stacked into boxes or tied and shipped to an ultimate customer. When the customer is ready to use the carton, each blank is removed and placed on an assembly surface and, by applying pressure to the exposed edges 46 and 50 toward the center roughly along the force lines A and B of FIG. 4, the blank is popped or formed into a tubular shape. At this point, a blow is administered depthwise along the partial cut or slit 62 in the direction of the arrow C which severs the partial cut throughout its length to form two portions 73,74. The set-up person with one hand on side 18 and the other hand on side 16 depresses and folds the severed top portions 73,74 into the corners, which portions 73,74 will fold along the score lines 64 and 65. The tabs 67 along score lines 64,65 will pop into the slots 42 with parts 75 of the portions 73,74 lying inside the sides 16 and 18 and with the other parts 76 of the portions 73,74 lying inside and parallel to the back panel 14 as is shown somewhat schematically in FIG. 5, and in FIGS. 6 and 7. The side tabs 48 and 70 on each end are folded toward each other whereupon the ends 20,22 are folded down over said tabs 48,70 so that the tabs 59,60 can be inserted into the ends of the carton. The tabs 43,44 are now folded down and engaged with tongues 61. The tabs 43,44 are guided by the tongues 61 into the slots formed in the ends 20,22.

Figures 8, 9, 10:
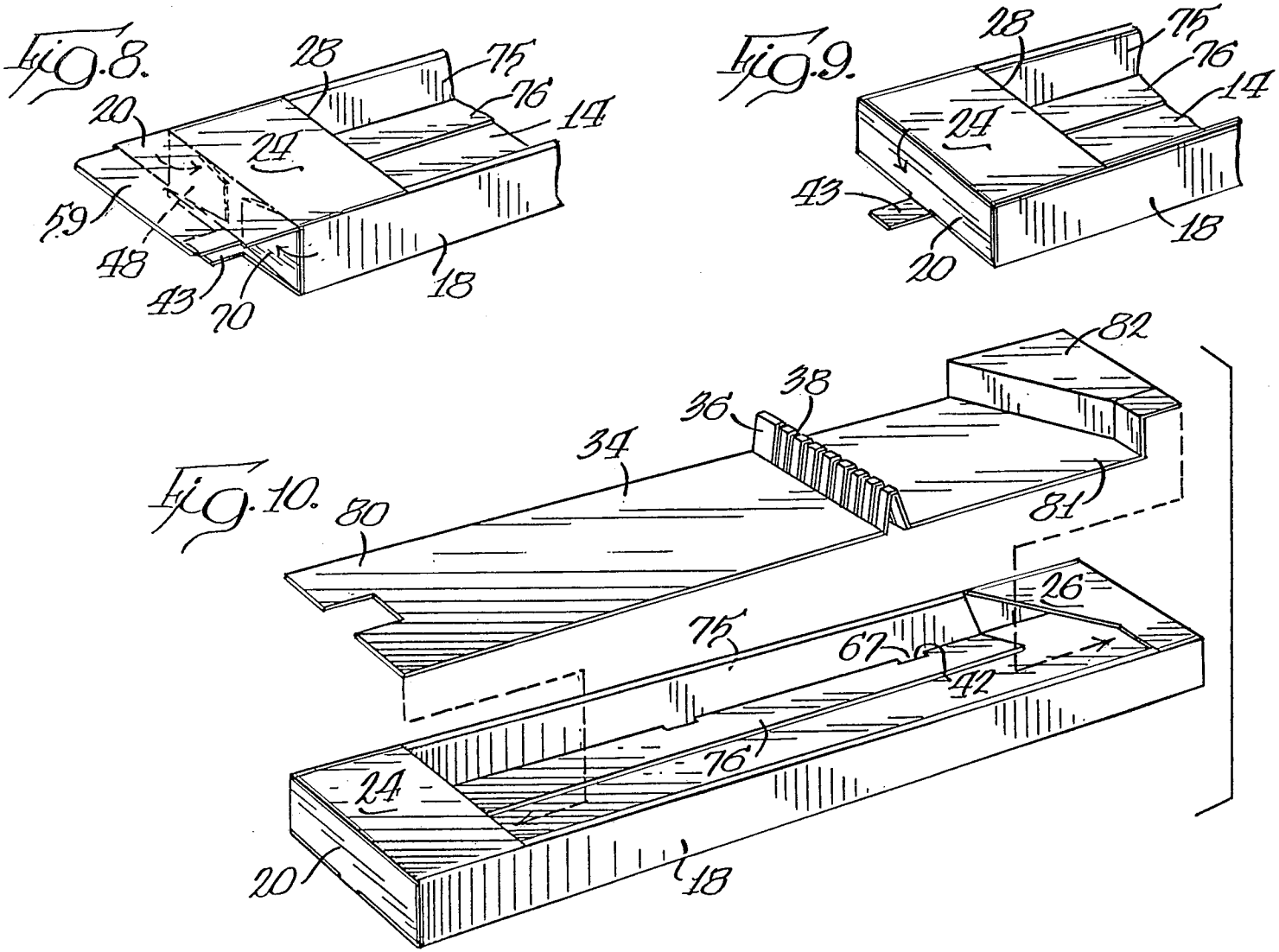
FIG. 8 is a partial end view showing the end of the carton being assembled.
FIG. 9 is a partial end view similar to FIG. 8 only showing the final step of the assembly of the end of the carton; and, FIG. 10 shows an insert positioned above the opening in the carton with dashed lines indicating the positioning of the insert in the carton.

An insert 34, see FIG. 10, is now set up by moving each end 80 and 81 toward each other to raise the slotted article support 36 upwardly from the plane thereof. An end pillow or block 82 is formed from the material of the insert 34 or is glued to said insert and has a shape substantially equal to the shape of the overhanging portion 26 of the carton. The insert 34 is lifted at the center to allow the ends 80,81 to hang down somewhat in the shape of an open "V" whereupon the end 80 is threaded into the cavity of the carton below the overhanging portion 24 and the block or end 82 is threaded in under the overhanging portion 26. The center of the insert 34 is now depressed into the cavity in the carton which will force the ends 80 and 81 into position in the carton. The length of the insert will fit snuggly between the parts 75 of the portions 73,74 and sides 16,18, respectively, so as to support the sides 16,18 of the carton.

Sides 16 and 18 backed up by the portions 73,74 and article support 36 will not bow or spread outwardly in the midportion thereof. The article support 36 in the insert 34 will prevent the sides 16 and 18 from collapsing inwardly into the cavity of the carton. The carton is now completely assembled ready to receive the articles to be displayed. A conventional-shaped top is brought down over the open top of the carton to complete the packaging of the articles.

It has been found that using my improved method of cutting and assembling a carton and, in particular, the setting up of the carton for receiving articles, a seventy-five percent saving in labor time is effected. That is, it takes only about one-fourth the usual time to set up a complete carton using my improved method of assembly. In effect, the carton, as shown in FIG. 3, is received by the customer and by a quick inward thrust on the edges 46 and 50, a tube is formed, a sharp blow on the partial cut 62 severs the center panels which are then grasped and pushed into position. The ends are quickly folded in and the insert is dropped into place and the carton is ready for use. The resulting carton is not only more easily and quickly set up, but it is sturdier, tougher and has been designed to present the articles contained therein for display as well as nesting them securely for safe shipment.

I claim:

1. A box blank for assembly into a display carton having a relatively long depth, a relatively short length and a medium width, a back panel, a fastening tab connected to said back panel along a score line, a first side panel connected along a score line with the opposite edge of said back panel, slots formed in said back panel with one edge of each slot aligning with one of the score lines along the edges of said back panel, a top panel connected to said first side panel along a score line, a second side panel connected along a score line to the opposite edge of said top panel, said fastening tab being adapted to be fastened to said second side panel to form said basic carton, said top panel having a pair of spaced apart slits spaced from the opposite end edges of the top panel and intersecting the score lines defining said top panel, three score lines formed in said top panel between said slits with the middle of said three score lines bisecting the top panel into two halves, said two remaining score lines having slits running parallel to the score lines and offset inwardly toward the middle score line to form tabs projecting from the score lines with the tabs lining up with said slots in the back panel so that when the carton is set up the tabs will project into the slots, and end sections extending from each end edge of the top panel and being adapted to be folded over the open end of the basic carton with a portion being tucked into the carton when the carton is assembled to form the ends of the carton.

2. A box blank as claimed in claim 1 wherein a first one of said spaced apart slits extends transverse to the score lines defining said top panel, and a second one of said slits is formed at an angle to one of the score lines defining said top panel and extending toward one end edge of the top panel with a knee formed in the second slit and the remainder of the slit extending transverse to the second score line defining said top panel.

3. A box blank as claimed in claim 1 wherein end tabs extend outwardly from opposite end edges of said back panel, said end tabs being adapted to be threaded into slots in the end sections when the end sections are folded into the open ends of the assembled carton.

4. A box blank as claimed in claim 1 wherein end tabs project from the opposite ends of both side panels, whereby when the basic carton is assembled said end tabs are folded over the open ends of the basic carton prior to the end sections being folded and tucked into the ends of the carton.

5. A box blank for assembly into a display carton having a relatively long depth, a relatively short length and a medium width, a back panel, a fastening tab connected to said back panel along a score line, a first side panel connected along a score line with the opposite edge of said back panel, at least two slots formed in said back panel with one edge of each slot aligning with one of the score lines along the edges of said back panel, a top panel connected to said first side panel along a score line, a second side panel connected along a score line to the opposite edge of said top panel, said fastening tab being adapted to be fastened to said second side panel to form a basic carton, end tabs extending outwardly from opposite ends of said back panel with cuts running parallel to the score lines between the back panel and the side panels for separating the sides of the end tabs from the back panel, each end tab having two parallel score lines extending in a direction transverse to the direction of said previously mentioned score lines, one of said score lines in each tab being located at the junction of the tab with the back panel and the other being aligned with the end edges of the back panel, said top panel having a first slit extending transverse to the score lines between the top panel and the side panels and being spaced from one end edge and a second slit formed at an angle to one score line between the top panel and one side panel and extending toward the second end edge with a knee formed in the slit and the remainder of the slit extending transverse to the score line between the top panel and the other side panel, three score lines formed in said top panel between said slits with the middle of said three score lines bisecting the top panel into two halves and with the remaining two score lines being spaced from the score lines defining the top panel by an amount substantially equal to the length of each side panel, said two remaining score lines having short slits running parallel to said two remaining score lines and offset inwardly toward the middle of the three score lines to form tabs projecting from the score lines with the tabs lining up with said at least two slots in the back panel so that when the carton is set up the tabs will project into the slots, end sections extending from each end edge of the top panel and individually defined by a pair of score lines, one of said last named score lines being at the end edge of the panel and the second of said score lines being spaced from the end edge an amount equal to the length of each side panel, each end section having a slot parallel to said second score line and offset outwardly thereof to form a tongue with a slot underneath when said end sections are folded along the second score line, said end sections being tucked into the carton when the carton is assembled to form the ends of the carton with the end tabs on the back panel being threaded into the slots in the end sections.

* * * * *